United States Patent [19]

Brookfield

[11] Patent Number: 5,074,045

[45] Date of Patent: Dec. 24, 1991

[54] TOOL

[75] Inventor: Peter A. M. Brookfield, Auckland, New Zealand

[73] Assignee: Paper Tiger Systems Limited, Auckland, New Zealand

[21] Appl. No.: 570,955

[22] Filed: Aug. 20, 1990

[30] Foreign Application Priority Data

Aug. 31, 1989 [NZ] New Zealand ..... 230500

[51] Int. Cl.[5] ..... B26B 3/04; B26B 3/03; B26B 7/00; B26F 1/00

[52] U.S. Cl. ..... 30/172; 30/169; 30/276; 30/365; 30/347

[58] Field of Search ..... 30/169, 172, 265, 276, 30/173, 299, 365; 56/255, 295

[56] References Cited

U.S. PATENT DOCUMENTS

| | | | |
|---|---|---|---|
| 1,040,241 | 8/1983 | Fischer et al. | 30/365 |
| 4,502,223 | 3/1985 | Brookfield | 30/365 |
| 4,546,513 | 10/1985 | Hammond | 30/169 |
| 4,987,732 | 1/1991 | Terai et al. | 30/276 |

*Primary Examiner*—Douglas D. Watts
*Assistant Examiner*—Paul M. Heyrana, Sr.
*Attorney, Agent, or Firm*—Young & Thompson

[57] ABSTRACT

In its preferred form the present invention provides a tool for scarifying wallpaper, to create holes by which steam or water can get behind paper stuck to a wall and thereby assist in removing it. The tool includes a pair of sharp toothed wheels rotatably mounted at an angle to each other on a rolling or pivoting block, so that rolling or pivoting the block between two positions can alter the angle between the two wheels in relation to the wallpaper, to be appropriate for scarifying movement of the tool either backwards or forwards.

16 Claims, 6 Drawing Sheets

TOOL

FIELD OF THE INVENTION

This invention relates to surface breaking or scarifying tools having rotatable rollers, discs or cutters capable of being moved over a surface to be cut or scratched. Such scarifying tools are used to perforate wallpaper, and also to break the surface of the ice on car windscreens, footpaths, steps or the like to assist in removing it.

BACKGROUND

A variety of tools have been known and used in the past for the purpose of scarifying or breaking up a surface, an example of which is illustrated in my earlier U.S. Pat. No. 4,502,223. Such tools have been found to be particularly effective when the cutting or breaking elements are arranged to impart a sideways force across the surface and across the direction of travel of the tool.

A disadvantage hitherto associated with such an arrangement, however, has been that although the tool is moved back and forth across the surface in a scrubbing type of motion, it only cuts into the surface while moving in one direction, and has little or no effect on the surface on the return stroke. It has also been found difficult to provide a simple and effective means for precisely limiting the depth of penetration of the cutters on a surface such as wallpaper, particularly on uneven surfaces such as embossed or textured wallpaper.

SUMMARY OF THE INVENTION

It is an object of the present invention to go at least partway towards providing a novel and improved tool for scarifying, or at least to provide the public with a useful choice.

In one aspect the present invention provides a tool for scarifying a surface or removing ice therefrom, including:

at least one pair of rotatably mounted opposing discs;

each said disc including a central aperture by which the disc is mounted on an axle to rotate relative to the axle, a plurality of sharp teeth radiating outwardly from the rim of said disc and depth control means, rotatable with said disc on said disc axle, lying transversely relative to said teeth and adjacent said teeth.

Preferably said teeth radiate conically outward from the rim of said disc, inclined out of a plane orthogonal to said axle.

Preferably said depth control means comprises a second plurality of sharp teeth, radiating conically outward from the rim of said disc, inclined out of said plane on the opposite side from the first said plurality of teeth so as to project transversely relative to the first said plurality of teeth;

said first and second pluralities of teeth being arranged to alternate around the rim of said disc.

In another aspect the invention provides a tool including a carriage element on which said at least one pair of discs is mounted, said element being movable relative to a body of said tool, such that said disc axles can be moved to at least two different orientations relative to said body;

wherein at each said orientation said discs are non-parallel with respect to each other, with respect to a direction of travel of the tool and with respect to a line orthogonal to the surface at a point of contact between said surface and said disc;

whereby in use movement of the tool in a said direction of travel can cause said discs to roll and impart opposed sideways forces on said surface at spaced apart positions of contact with the surface.

Preferably the carriage element is movable about a carriage axis of rotation substantially orthogonal to a plane of symmetry between said non-parallel disc axles, such that said carriage element can be pitched at different angles within said plane of symmetry, different said angles providing different said orientations of the disc axles relative to the body.

DESCRIPTION OF THE PREFERRED EMBODIMENTS

A wide variety of tools have hitherto been known for the purpose of scarifying or puncturing wallpaper, so as to allow water or some other solvent to seep in behind the paper and thereby make it easier to remove. Such tools have often included some form of serrated edge or wheel which is dragged across the surface of the wallpaper. It has been found preferable with such tools to drive the teeth into the paper obliquely by some means, rather than straight down, so that the tool does not need to be pressed heavily against the wall to penetrate the paper, but rather so that the movement of the tool across the wall helps drive the teeth into the paper.

Figure 2A:
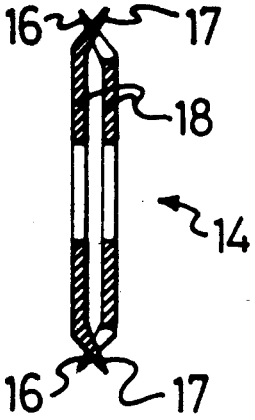
FIG. 2*a*: illustrates a preferred cutting wheel in end view and cross-section.
Figure 3:
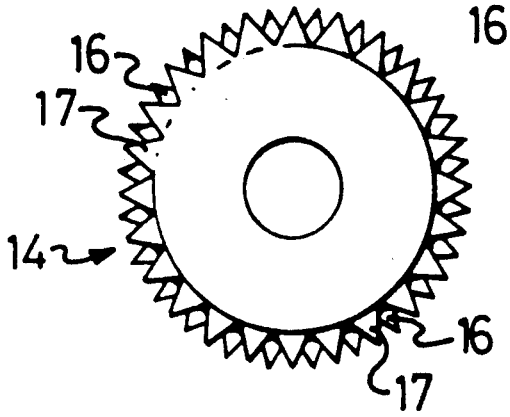
FIG. 3: illustrates the wheel of FIG. 2*a* in side view.
Figure 2B:
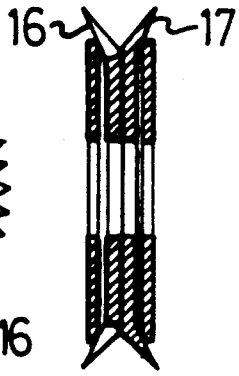
FIG. 2*b*: illustrates an alternative cutting wheel in end view and cross-section.

The preferred form of the present invention includes a pair of cutter wheels 14 and 15, which can readily provide an oblique piercing action as the tool is moved across a surface. The cutter wheels 14 and 15, illustrated in FIGS. 2 and 3, are preferably formed with sharp radial teeth around the entire outer circumference, alternately inclined to one side or the other so as to provide a bank of generally outwardly projecting teeth 16 (relative to a body 12 in the center) and a bank of generally inwardly projecting teeth 17. This form of wheel may conveniently be provided by the use of two pressed metal discs 18 brought together face to face as shown in FIG. 2, with the inclined teeth of one in register with the gaps between teeth of the other.

Figure 8:
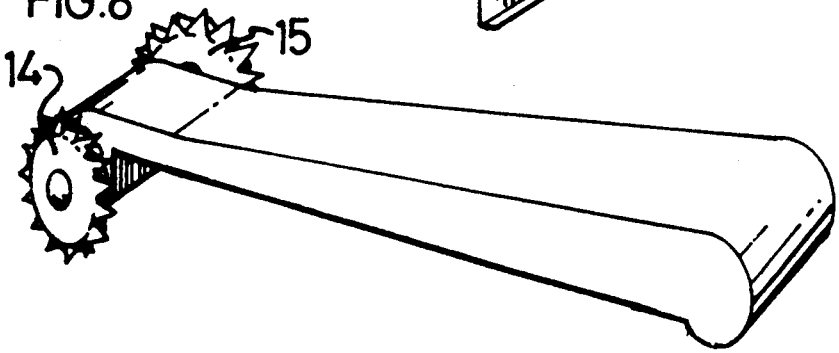
FIG. 8: illustrates a tool incorporating cutter wheels of the present invention.

Such wheels 14 and 15 could be used in a mono-directional cutter, as shown in FIG. 8, if mounted on fixed axles connected to a handle and inclined so as to converge (for example) towards the front and top of the wheels. If arranged to converge towards the top, the inwardly projecting teeth 17 on each wheel will be angled down into paper on which the tool is used, while the outwardly projecting teeth 16 lie nearly parallel with the paper, and act as guards to prevent the downwardly projecting teeth 17 from penetrating too deeply. If with such an arrangement the wheels 14 and 15 are also arranged to converge towards the front of the tool, the inwardly projecting teeth 17 will converge as they roll down onto the paper when the tool is pulled backwards and will cut inwards before tearing back up through the paper. This convergence of the inwardly projecting teeth drives the points of the teeth into the paper. If arranged to converge towards the back of the tool, the inwardly projecting teeth will converge and drive into the paper when the tool is pushed forward. In either case with a fixed axle tool of this type, on the return stroke the teeth will not tend to penetrate the paper, because they will diverge as they contact the paper and tend to pull back across it rather than pushing into it.

Alternatively the wheels 14 and 15 may be arranged to converge towards the bottom, such that the outwardly projecting teeth 16 are angled more downwardly into the paper while the inwardly projecting teeth 17 lie on the surface of the paper and act as depth guards. In such a case the teeth will drive into the paper when movement of the tool causes them to diverge as they contact the paper, and conversely they will not penetrate the paper when moved so as to converge, on the return stroke.

Figure 1:
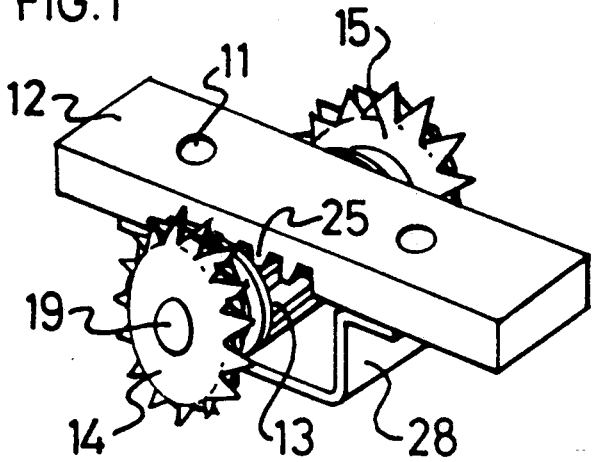
FIG. 1: illustrates a first cutting head of the present invention in perspective view.

The preferred apparatus of the present invention provides means by which the paper can be cut both when the tool is moved forwards and when it is moved backwards, comprising a hand held tool incorporating one or more cutting heads 10 as shown in FIG. 1. The handle portion may take any of a variety of known forms, and may conveniently be fixed to the cutting head 10 by fasteners such as screws, bolts or the like passed through retaining holes 11.

The cutting head 10 has four principal components, these being a body 12 through which the holes 11 pass, a carraige element in the form of a rolling or pivoting block 13 mounted under the body, and two cutter wheels 14 and 15 rotatably mounted on the block 13 to either side of the body 12. Rather than being mounted on fixed axles, the axles 19 are mounted on the rolling or pivoting block 13, which shifts as the direction of movement of the tool is reversed, so as to change the orientation of the wheels to suit the change in direction.

Figure 4:
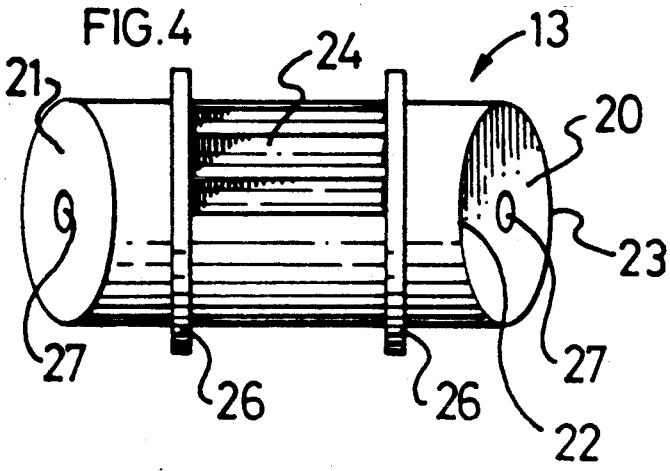
FIG. 4: illustrates a first embodiment of a rotatable block element of the present invention in front view.

The block 13 as shown in FIG. 4 is preferably generally cylindrical in shape, with end walls 20 and 21 converging as shown, so that the end walls are closest together at the point 22, and furthest apart at the point 23. The curved side of the cylinder is provided with a rack of notches 24, which in use engage with corresponding teeth 25 on the body 12. Annular flanges 26 may be provided to either side of the notched area as shown, which in normal use run along either side of the body 12 and act to retain the block 13 in position relative to the body 12. Axles 19 are in normal use mounted in apertures 27 in either end wall, so as to project orthogonally relative to that end wall, rather than parallel to the general axis of the block 13. The wheel 14 will therefore rotate in a plane parallel to the end wall 20, and the wheel 15 will rotate in a plane parallel to the end wall 21.

Figure 5:
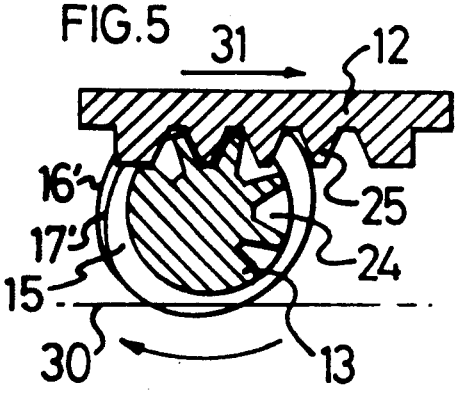
FIG. 5: schematically illustrates the cutting head of FIG. 1 in side view and cross-section, in a first cutting configuration.
Figure 6:
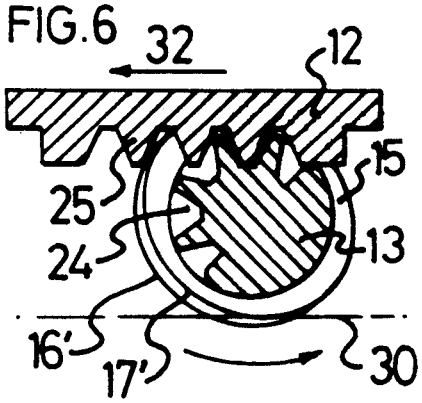
FIG. 6: schematically illustrates the cutting head of FIG. 5 in a second cutting configuration.

The block 13 is held in association with the body 12 by the flanges 26 and by a bracket element 28, with the teeth 25 on the body engaged with the notches 24 on the block. The bracket 28 is longer than the diameter of the block 13, and consequently the block 13 is able to roll along the body 12 a short distance, with the racks of teeth 25 and notches 24 still in engagement. As shown in FIGS. 5 and 6, this allows the block to move between two extreme positions.

Movement of the tool will tend to roll the block 13 into one of these two positions, where it is prevented from further rolling by the termination of the racks of teeth 25 and notches 24 and by the end wall of the bracket 28 (not shown in FIGS. 5 and 6). When the block 13 can roll no further, the wheels 14 and 15 in normal use will rotate on their axles 19 instead.

In the position illustrated in FIG. 5, the block 13 is at one end of the rack of teeth 25, and will not in normal use roll any further (being held by the bracket 28, not shown). Preferably when in this position, the wheels 14 and 15 lie in planes inclined at an angle of approximately 5° from orthogonal to the surface to be scarified, or between 2° and 10° from orthogonal, and at an angle of approximately 20°, or between 10° and 30°, to the direction of travel of the tool. It will be appreciated that as the block 13 is rotated, the inclination of the wheels relative to the surface will increase, and the inclination of the wheels relative to the direction of travel proportionately decrease, or vice versa.

The point 22, at which the end walls 20 and 21 are closest together, is positioned towards the top and back of the block 13, and the point 23 of greatest divergence is positioned towards the front and bottom of the block 13. Consequently the inwardly projecting teeth 17, schematically represented by a single line 17', will be angled downwardly into the paper 30, while the outwardly projecting teeth (represented by line 16') lie across the paper 30 and prevent deeper penetration by the teeth 17. This is also the position illustrated in FIG. 1. As the tool is moved forwards in the direction of arrow 31, the teeth 17 in contact with the paper are driven inwardly as they rotate from the point of greatest divergence 23 towards the point of greatest convergence 22. This acts to drive the teeth 17 into the paper.

When the direction of movement of the tool is reversed, the wheels 14 and 15 momentarily cease rotating on the axles 19, and instead the whole block 13 rolls along the rack of teeth 25 to the other end as shown in FIG. 6, where again it is held by the bracket 28 and termination of the racks of teeth and notches. This involves a rotation in the preferred embodiment, through approximately 90°, although it should be appreciated that the apparatus may still operate effectively with a rotation through significantly less than or greater than 90°, depending on the angle of inclination of the disc and of the teeth. Again, the wheels start rotation on the axles 19 when the block can roll no further. Because the orientation of the block has been changed by rolling from one end of the rack to the other, the point 22 is now positioned towards the bottom and back of the block 13, rather than the top and back, and correspondingly, the point 23 of greatest divergence is positioned towards the front and top of the block 13. Because the point 22 is now towards the bottom rather than the top, the outwardly projecting teeth 16 are now angled downwardly into the paper 30, rather than the inwardly projecting teeth 17. As the tool is moved back in the direction of arrow 32, the teeth 16 in contact with the paper are driven outwardly, as they rotate from the point 22 of greatest convergence towards the point 23 of greatest divergence. This acts to drive the teeth 16 into the paper.

Thus the paper 30 is cut both on the forward and on the reverse strokes. As a consequence, the speed and efficiency with which a surface can be scarified may be greatly increased.

Figure 7:
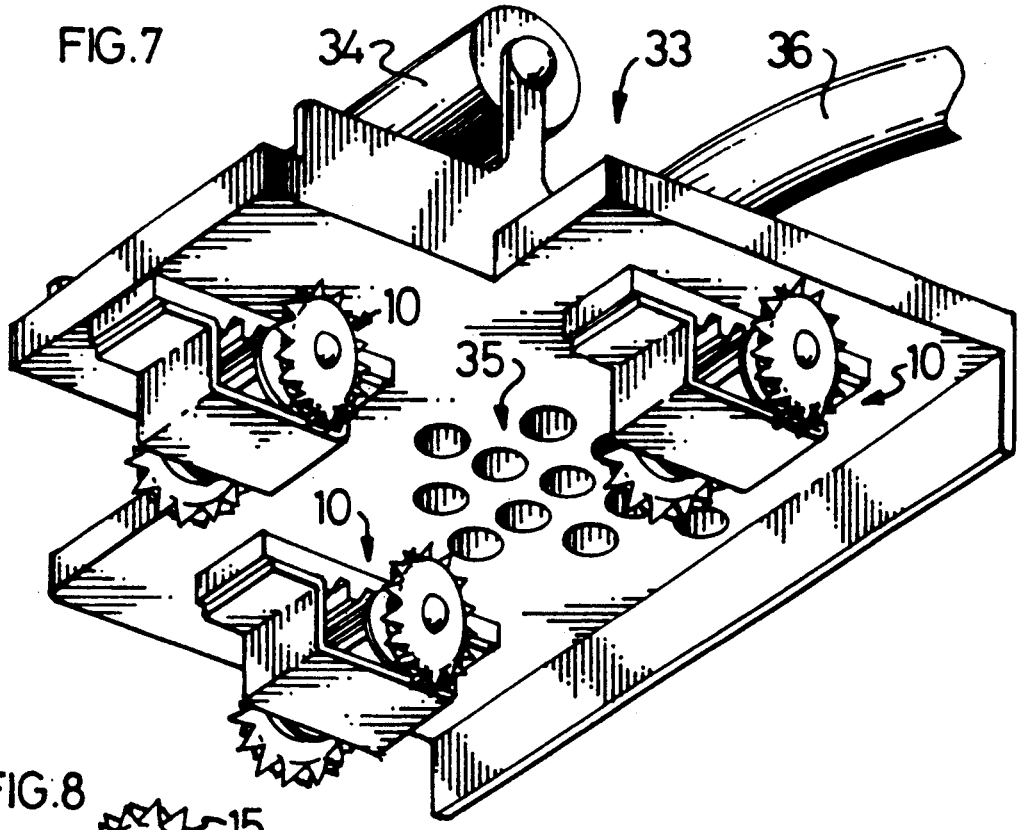
FIG. 7: illustrates a "scrubbing" tool incorporating the cutting heads of FIG. 1.

Preferably cutting heads 10 of the present invention are incorporated into a tool 33 as shown in FIG. 7, having three such cutter heads arranged in parallel configuration and spaced apart as shown. A handle 34 is provided on the upper face of the tool, and preferably a source of steam, water or other solvent is also provided, connected to an outlet 35 in the body of the tool 33 by a pipe 36. By this means the solvent can be applied to the surface and pass through the holes in the paper as they are created by the cutting heads 10. Alternatively the water, steam or other solvent might be applied as a separate operation, and the tool 33 comprise a scarifying tool only, or the tool might include a water reservoir as an integral part of the unit.

Figure 9:
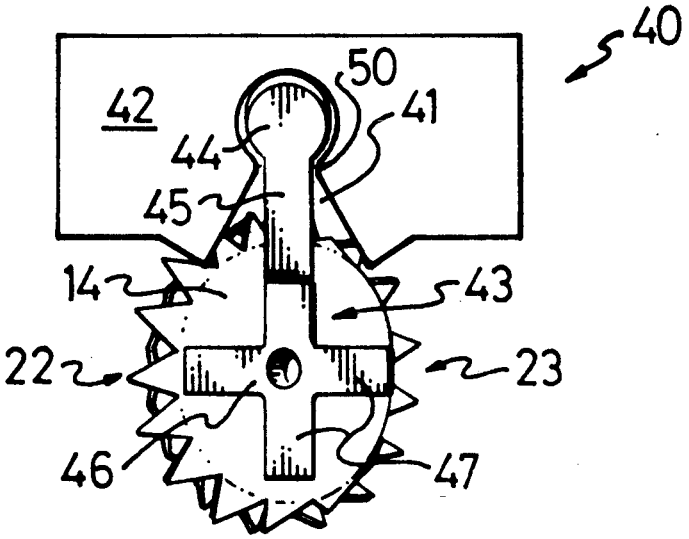
FIG. 9: illustrates a second head of the present invention in side view, with one cutting wheel absent.
Figure 10:
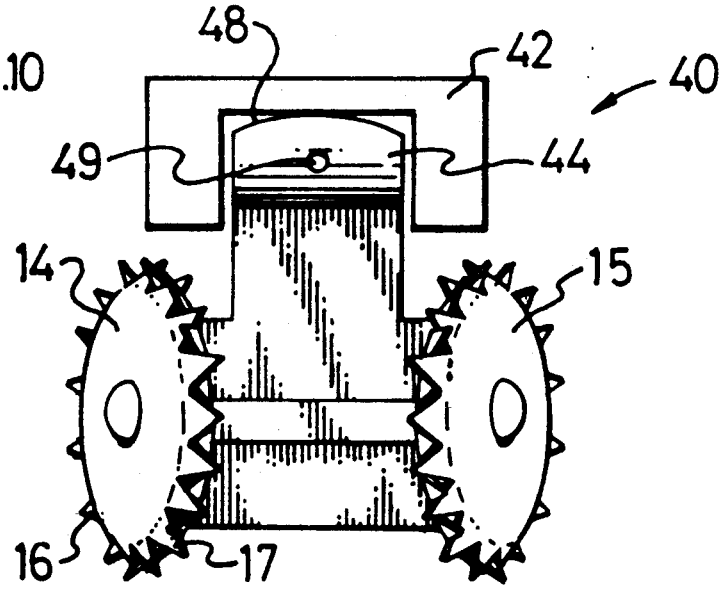
FIG. 10: illustrates the cutting head of FIG. 9 in front view, with both cutting wheels present.

It should be appreciated that the rolling block element 13 is not the only means by which the axles 19 or axes of rotation of the wheels 14 and 15, can be rotated relative to the surface to be scarified. As shown in FIGS. 9 and 10, a pivotal arrangement can be used to achieve the same result. A pair of wheels 14 and 15 are arranged in a cutting head 40, comprised of a socket 41 in a tool body 42, and a pivotal element 43 on which the wheels 14 and 15 are rotatably mounted. As with the example illustrated in FIGS. 1 to 6, the axes of rotation of the wheel 14 and 15 are not parallel, but rather are arranged at an angle to each other so that the wheels 14 and 15 converge towards one side 22 and diverge towards the other 23.

The element 43 includes a head portion 44 adapted to pivotally fit into and be retained in the socket 41, a stem or leg 45 depending from the head 44 and a base 46. The base 46 may take a variety of forms, but preferably is generally cruciform, or T or Y-shaped in cross-section, having flanges 47 to provide lateral support for the rims of the wheels 14 and 15 while at the same time not giving too large an area of frictional contact between the sides of the base 46 and the inside surfaces of the wheels. Preferably the element 43 is formed from a material such as nylon, which is slightly resilient to facilitate snap-fitting into the socket 41, and also preferably does not require lubrication at the pivot head or axle mounting.

As is particularly shown in FIG. 10, the top face 48 of the head portion 44 is preferably slightly convex as shown, and allowed a small degree of rolling movement in a lateral plane. This allows the element 43 to roll slightly and thereby compensate for unevenness in the surface to be scarified, so that such unevenness or irregularity will not result in one wheel of the pair losing contact with the surface. It should be appreciated that the pair of wheels act in concert to some extent, each bearing against the other to drive the teeth 16 or 17 into the surface. Alternatively, the portion of the tool body 42 housing the socket 41 might be movably connected to the remainder of the body 42, so that substantially the whole cutting head 40 can "float" relative to the handle of the tool, and other associated cutting heads or bearing elements bearing on the same surface.

Figure 11:
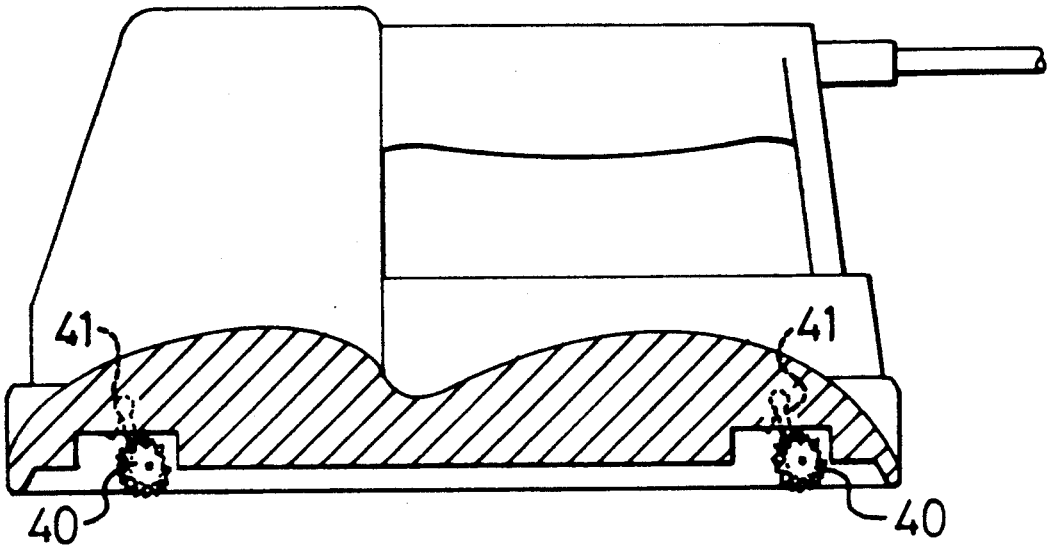
FIG. 11: schematically illustrates a steamer adapted to incorporate the cutting heads of FIG. 9.
Figure 12:
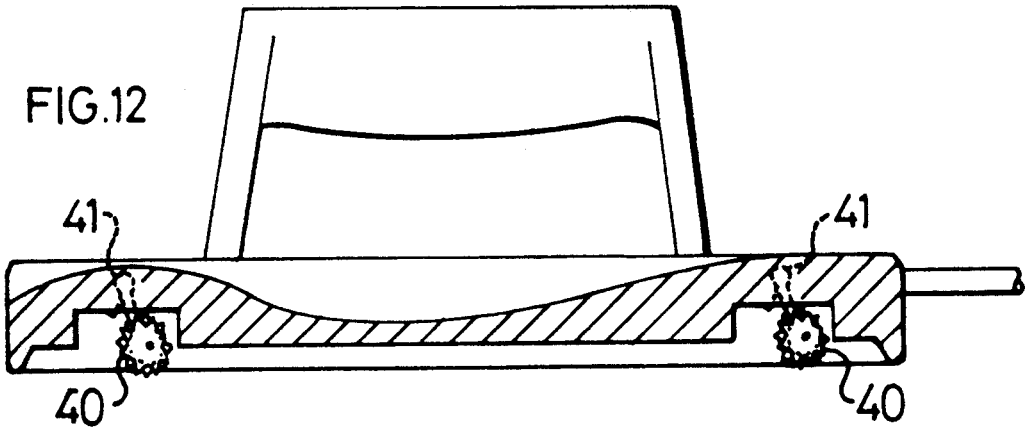
FIG. 12: schematically illustrates a steamer pad adapted to incorporate the cutting heads of FIG. 9.

It may also be found desirable to provide an aperture 49 in the head portion 44, to allow the element 43 to be secured in the socket 41 with a pin (not shown). Such securement should however be arranged so as to allow proper pivotal and rolling movement of the element 43, as described above. In many applications it may be found more preferable to have the element 43 retained in the socket solely by resilient snap-fitting engagement of the head portion 44 behind a constricted part 50 of the socket 41, which preferably is formed in a slightly resilient and flexible material. With such an arrangement it can be possible for cutting heads 40 to be removed, whether for replacement when the teeth 16 and 17 become worn, or to facilitate use of the tool for other purposes. As shown in FIGS. 11 to 17, cutting heads of the present invention might be removably attached to a variety of tools, adapted for the purpose by the provision of one or more sockets 41. In the case of tools such as steamers as illustrated in FIG. 11 and steamer pads as illustrated in FIG. 12, the cutting heads may enhance the ordinary or usual function of the tool, by perforating a surface as it is steamed, to facilitate entry of the steam into and behind the surface and thereby assist in removing paper or a like covering.

Figure 13:
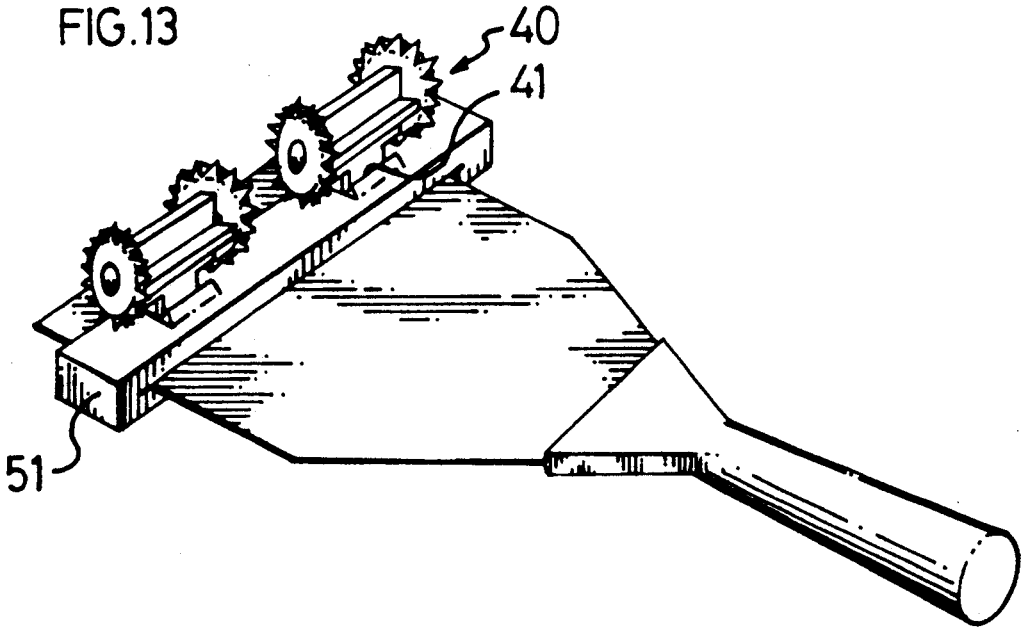
FIG. 13: illustrates apparatus for attaching the cutting heads of FIG. 9 to a scraper or like tool.
Figure 14:
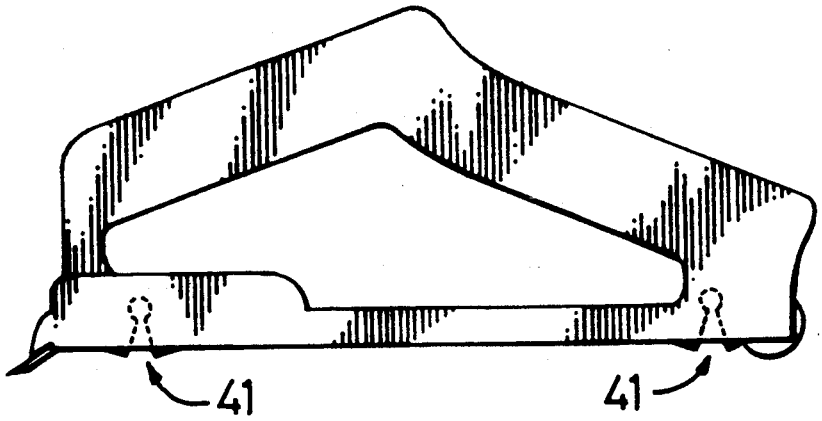
FIG. 14: illustrates a wallpaper planer adapted to accept the cutting heads of FIG. 9.
Figure 15:
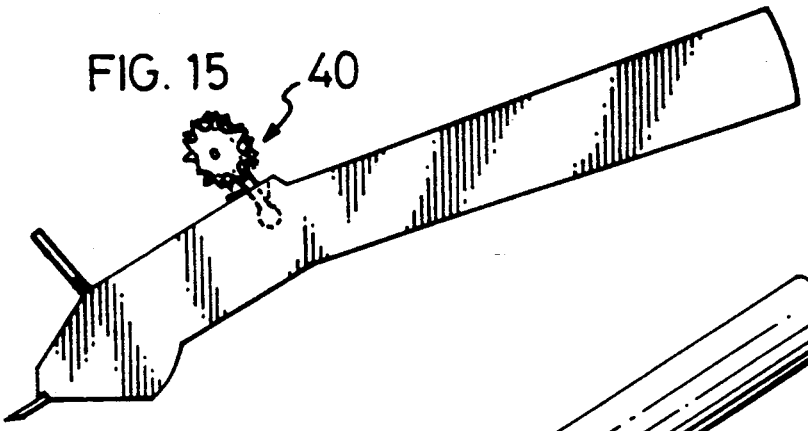
FIG. 15: illustrates a wall clearing tool incorporating the present invention.
Figure 16:
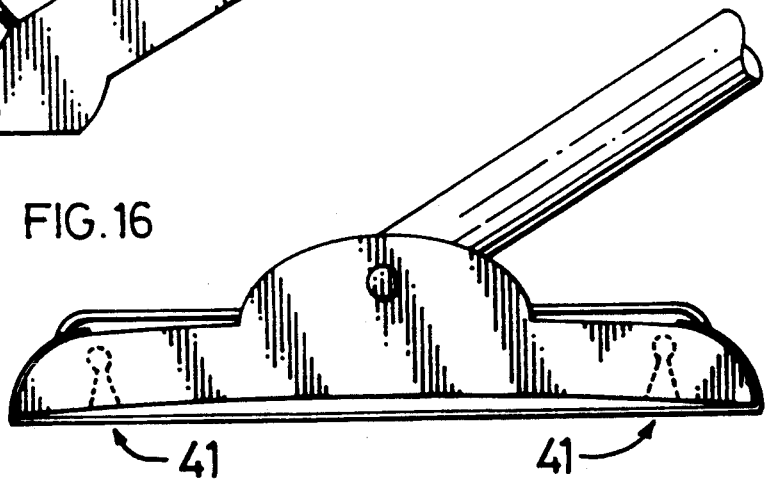
FIG. 16: illustrates a pole-sander block adapted to accept the cutting heads of FIG. 9.
Figure 17:
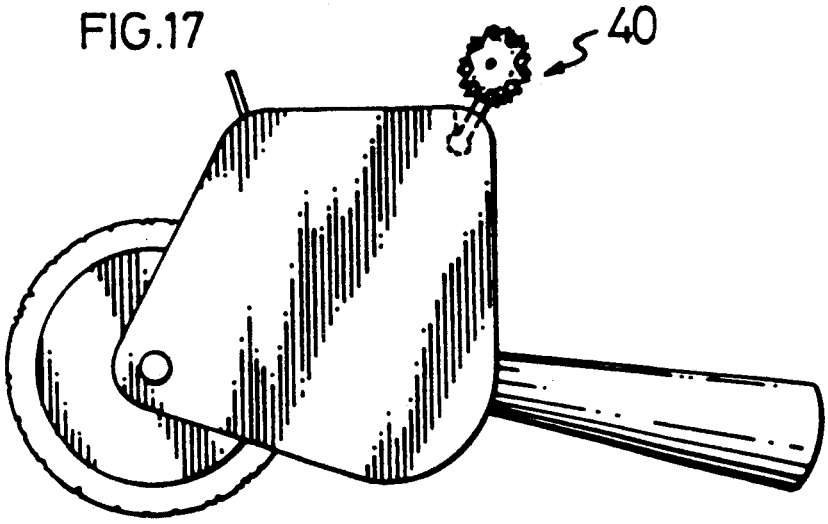
FIG. 17: illustrates a fluid applicator incorporating the cutting heads of FIG. 9.

Alternatively, in the case of tools such as scrapers, planers, sanding blocks or paint rollers, as illustrated in FIGS. 13 to 17, the cutting heads may provide an additional or secondary function for the tool rather than enhancing the primary function. It will be appreciated that interior decorators or home renovators commonly own and use one or more such pieces of equipment, and will often find it advantageous to be able to use the same equipment for the purpose of scarifying a surface. The sockets 41 may be provided in the body of the tool itself or, as shown in FIG. 13, might be provided on a separate frame or body 51, which can be fastened to the tool by screw fasteners, clamping means or the like (not shown). Preferably the sockets are positioned so that the tool may still be used for its primary purpose while the cutting heads are in place, as illustrated in FIGS. 15 and 17, by reversing and/or tilting the tool, but because the cutting heads 40 can quite readily be removed and replaced in the sockets 41, it may be found quite feasible in practice to alter the tool by adding or removing cutting heads 40, and to adapt it solely for one purpose or another.

Other forms of tool might equally be provided using one or more cutting heads 10 of the present invention, and adapted in form to suit a particular type of operation.

A variety of changes might also be made in the form of the cutting heads illustrated in the above example, within the scope of the present invention.

While it is preferable for the cutting wheels 14 and 15 to have two rows of teeth, 16 and 17, one of which acts to cut into the paper and the other of which acts as a depth guard to prevent the tool from cutting too deeply, it may be possible to provide a cutting head having only (for example) inwardly projecting teeth, wherein the point at which the wheels are closest together rolls or pivots from a top-back position to a top-front position when the direction of movement changes, rather than from top-back to bottom-back as in the example described above. In such a case a blunt-toothed wheel could be provided as an outwardly projecting depth guard, or some other means used to achieve the same object. Such an arrangement is particularly suitable for use on ice-breaking tools, which preferably have very widely splayed wheels, lying almost parallel to the surface being cut. This arrangement directs the force provided by movement of the tool more into the sideways movement of the teeth, and less into the downward penetration of the surface, than with a tool with more upright wheels. It will be appreciated that when the wheels are lying flat in this fashion it is generally inconvenient to flip them over so as to employ a second set of teeth on the return stroke of the tool, and generally more convenient to reverse the inclination of the wheels, so that it remains the same with respect to the direction of travel in the reverse direction.

Figure 18A:
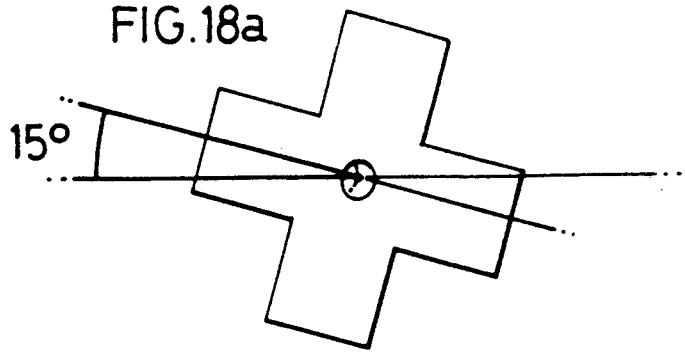
FIG. 18*a*: schematically illustrates the carriage element of a cutting head of the present invention in side view, showing the inclination of the wheel axes relative to horizontal at an operational angle.
Figure 18B:
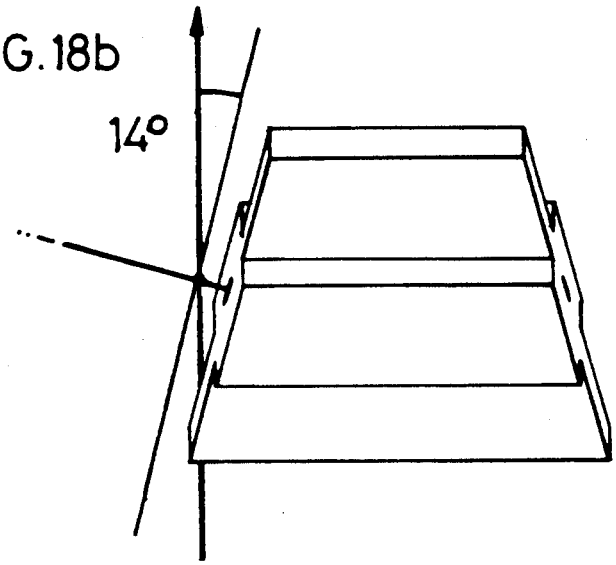
FIG. 18*b*: schematically illustrates the carriage element of FIG. 18*a* in plan view, showing the angle of the wheels relative to the direction of travel at the same operational angle.
Figure 18C:
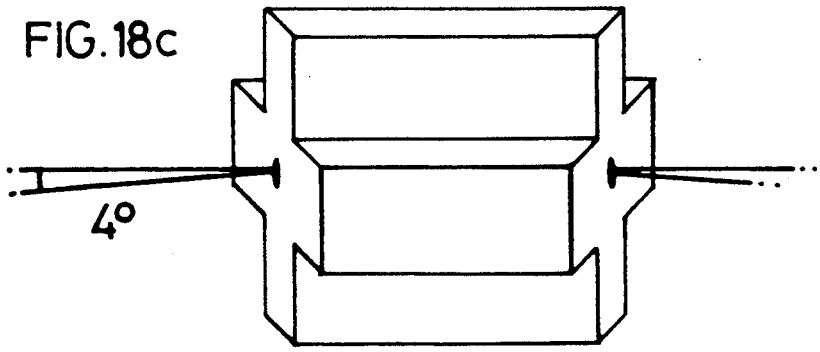
FIG. 18*c*: schematically illustrates the carriage element of FIG. 18*a* in front view, showing the splay or tilt of the wheels relative to vertical, at the same operational angle.

Similarly, the block could be arranged to roll or pivot through approximately 180°, rather than approximately 90° as in the examples above, to present different wheel arrangements when moving in different directions. However, it is preferred that movement of the block or equivalent be minimized, because the teeth do not cut the surface while the block is rolling, and consequently such rolling reduces the efficiency of the cutting stroke. For this reason, it may generally be found more preferable for the degree of roll or pivot to be less than 90°, rather than greater. It has been found in practice that, as illustrated in FIGS. 18*a, b,* and *c*, a roll or pivot through 30° (i.e.: 15° to either side of horizontal) with wheel axes having an included angle of approximately 150° between them, will provide a wheel angle relative to the direction of travel (as shown in FIG. 18*b*, as 14°) which gives adequate sideways motion of the teeth while in contact with the surface, and also will present one or other set of teeth at an appropriate inclination to be driven into the paper by the sideways motion.

Other modifications might be made to the form of the wheels and the tool generally to suit different purposes-for example, plastic or brass wheels might be provided on a tool intended for scarifying ice on car windscreens, so as to remove it without risk of scratching or otherwise damaging the windscreen itself. A considerably larger tool might be provided, having larger cutting wheels mounted in the same way and pivotally fixed to a broom or spade type handle, for use in removing ice from road or pavement surfaces. The wheels might also be made with separate tooth or pin elements clamped or otherwise fixed onto wheel hubs, rather than having teeth formed as an integral part of the wheel, by stamping, molding or the like.

The form of the block 13 might also be altered considerably, possibly with corresponding changes in the body 12. The racks of teeth and notches by which the block and body are engaged may take a variety of forms, but should provide secure engagement without inhibiting the rolling action of the block, so as to avoid slipping or jamming. The block 13 might be rotatably mounted on an axle rather than arranged to roll back and forth, but the additional complexity of construction involved in such an embodiment makes it appear less preferable at present. Each cutting wheel might be individually mounted on a separate block or axle arrangement, rather than being mounted in pairs as illustrated above, but this also appears less desirable at present. The body 12 and bracket 28 might also be changed considerably within the general scope of the present invention, which may be characterized by the following claims:

I claim:

1. A tool for scarifying a surface or removing ice therefrom, including:

at least one pair of rotatably mounted opposing discs;

each said disc including a central aperture by which the disc is mounted on an axle to rotate relative to the axle, a plurality of sharp teeth radiating conically outward from the rim of each said disc, said teeth being inclined out of a plane orthogonal to said axle, depth control means rotatable with each said disc on said disc axle, said depth control means being disposed transversely relative to said teeth and adjacent said teeth, said depth control means comprising a second plurality of teeth, radiating conically outward from the rim of each said disc, inclined out of said plane on the opposite side of said plane from the first said plurality of teeth so as to project transversely relative to the first said plurality of teeth;

said first plurality of teeth alternating with said second plurality of teeth around the rim of said disc.

2. A tool as claimed in claim 1, wherein each said disc is comprised of two plates, each having a central aperture and each said plurality of teeth radiating conically outward from the rim of its associated said plate; said plates being abutted face to face with said teeth intermeshed and said apertures in alignment.

3. A tool as claimed in claim 1, wherein said discs of said at least one pair are spaced apart from each other at points of contact with said surface, and wherein said axles are non-parallel.

4. A tool as claimed in claim 3, further including a carriage element on which said at least one pair of discs is mounted, said carriage element being movable relative to a body of said tool, such that said disc axles can be moved to at least two different orientations relative to said body;

wherein at each said orientation said discs are non-parallel with respect to each other, with respect to a direction of travel of the tool and with respect to a line orthogonal to said surface at a point of contact between said surface and said disc;

whereby in use movement of the tool in a said direction of travel can cause said discs to roll and impose opposed sideways forces on said surface at spaced apart positions of contact with the surface.

5. A tool as claimed in claim 4, wherein said carriage element is movable about a carriage axis of rotation substantially orthogonal to a plane of symmetry between said non-parallel disc axles, such that said carriage element can be pitched at different angles within said plane of symmetry, different said angles providing different said orientations of the disc axles relative to the body.

6. A tool as claimed in claim 5, wherein said carriage element is rollably held on said body.

7. A tool as claimed in claim 5, wherein said carriage element is pivotally held on said body.

8. A tool as claimed in claim 5, wherein said carriage element is fastened to said body by a flexible stem.

9. A tool for scarifying a surface or removing ice therefrom, including:

at least one pair of rotatably mounted opposing discs, each said disc including a central aperture by which the disc is mounted on an axle to rotate relative to the axle;

said discs of a pair being spaced apart from each other at points of contact between said surface and said discs, and being oriented so as to rotate in non-parallel planes;

each said disc including a plurality of sharp teeth radiating conically outward from the rim of the disc, inclined out of said plane of rotation of the disc, the direction of inclination of said teeth being opposed on the discs of said at least one pair;

a carriage element on which said at least one pair of discs is mounted, said element being movable relative to a body of said tool about a carriage axis of rotation, such that said carriage element can be positioned at two different orientations relative to said body;

wherein at each said orientation of the carriage element said discs are non-parallel with each other and with respect to a direction of travel of the tool;

whereby movement of the tool in said direction of travel can cause said discs to roll and impart opposed sideways forces on said surface at spaced apart positions of contact with the surface;

said sideways forces being in the direction of inclination of a plurality of said teeth;

and movement of the tool in the opposite direction can cause said carriage element to move about said carriage axis of rotation to a different said orientation.

10. A tool as claimed in claim 9, wherein each said disc includes a second plurality of teeth, radiating conically outward from the rim of said disc, inclined out of said plane on the opposite side of said plane from the first said plurality of teeth, and wherein at a first said orientation of the carriage element said opposed sideways forces are in the directions of inclination of a first plurality of teeth on each disc, and at a second said orientation of the carriage element said opposed sideways forces are in the directions of inclination of the second said plurality of teeth.

11. A tool as claimed in claim 10, wherein said second plurality of teeth project transversely across said first plurality of teeth, said first plurality of teeth alternating with said second plurality of teeth around the rim of said disc.

12. A tool as claimed in claim 11, wherein each said disc is comprised of two plates, each having a central aperture and each said plurality of teeth radiating conically outward from the rim of its associated said plate; said plates being abutted face to face with said teeth intermeshed and said apertures in alignment.

13. A tool as claimed in claim 11, wherein said discs of said at least one pair are spaced apart from each other at points of contact with said surface, and wherein said axles are non-parallel.

14. A tool as claimed in claim 9, wherein said carriage element is rollably held on said body.

15. A tool as claimed in claim 9, wherein said carriage element is pivotally held on said body.

16. A tool as claimed in claim 9, wherein said carriage element is fastened to said body by a flexible stem.

* * * * *